US012268352B2

(12) United States Patent
Hahn

(10) Patent No.: US 12,268,352 B2
(45) Date of Patent: Apr. 8, 2025

(54) SYSTEM COMPRISED OF A FLOOR PROCESSING DEVICE, A MEMORY DEVICE AND AT LEAST ONE ACCESSORY DEVICE

(71) Applicant: Vorwerk & Co. Interholding GmbH, Wuppertal (DE)

(72) Inventor: Frederic Hahn, Langenfeld (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 310 days.

(21) Appl. No.: 17/991,898

(22) Filed: Nov. 22, 2022

(65) Prior Publication Data

US 2023/0157502 A1 May 25, 2023

(30) Foreign Application Priority Data

Nov. 25, 2021 (EP) ..... 21210481

(51) Int. Cl.
*A47L 9/28* (2006.01)

(52) U.S. Cl.
CPC ..... *A47L 9/2826* (2013.01); *A47L 9/2842* (2013.01); *A47L 9/2847* (2013.01); *A47L 9/2857* (2013.01)

(58) Field of Classification Search
CPC .... A47L 9/2826; A47L 9/2842; A47L 9/2857; A47L 9/2847
See application file for complete search history.

(56) References Cited

U.S. PATENT DOCUMENTS

2020/0315418 A1* 10/2020 Howard ..... A47L 9/1409

* cited by examiner

*Primary Examiner* — Andrew A Horton
(74) *Attorney, Agent, or Firm* — Collard & Roe, P.C.

(57) ABSTRACT

A system has a floor processing device, a memory device and at least one accessory device for detachable connection with the floor processing device. The floor processing device has an acquisition device for acquiring the type of accessory device currently connected with the floor processing device, a user interface for receiving an operating specification for an operating parameter from a user, and a controller for controlling an operating activity according to the set operating parameter. The controller stores the operating parameter used last for a first operating activity together with information about the type of accessory device in the memory device and, after the accessory device has been disconnected from the floor processing device and then reconnected with the floor processing device, to access the stored operating parameter, and reset this operating parameter for a second operating activity to be performed chronologically after the first operating activity.

10 Claims, 2 Drawing Sheets

SYSTEM COMPRISED OF A FLOOR PROCESSING DEVICE, A MEMORY DEVICE AND AT LEAST ONE ACCESSORY DEVICE

CROSS REFERENCE TO RELATED APPLICATIONS

Applicant claims priority under 35 U.S.C. § 119 of European Application No. 21210481.4 filed Nov. 25, 2021, the disclosure of which is incorporated by reference.

BACKGROUND OF THE INVENTION

1. Field of the Invention

The invention relates to a system comprised of a floor processing device, a memory device and at least one accessory device for detachable connection with the floor processing device, wherein the floor processing device has an acquisition device for acquiring the type of accessory device currently connected with the floor processing device, a user interface for receiving an operating specification for an operating parameter of the floor processing device and/or the accessory device from a user, and a controller for controlling an operating activity of the floor processing device and/or the accessory device according to the set operating parameters.

2. Description of the Related Art

Systems of this general type are known in the prior art.

For example, a floor processing device in such a system can be a self-propelled floor processing device or also a floor processing device manually operated by a user. Floor processing devices are understood as devices that can process floors, for example vacuum, wipe, polish, sand, mow, sweep or the like.

The floor processing devices known in prior art, in particular floor processing devices manually operated by a user, are usually operated with accessory devices that can be detached from the floor processing device. The at least one accessory device here provides a specific floor processing tool, for example a suction nozzle for vacuuming suction material from a floor to be cleaned, a rotating brush, a swinging wiping plate or the like.

A user of the floor processing device usually transmits an operating specification for an operating parameter manually via a user interface, which can be formed on the floor processing device or which is connected with the floor processing device through wireless data communication. In this regard, a user interface of the floor processing device can also be part of a mobile external terminal, which is connected with the floor processing device. In particular, such an external terminal can be a mobile phone, a tablet computer or the like. For example, the user can use the user interface to transmit a specification for an operating parameter, such as a speed of a rotating cleaning brush, a suction power of a blower, a position of a switching element, for example of a displaceable sealing lip of a nozzle that is displaced based on the floor type, or others, to a controller of the floor processing device. For example, the user interface can be an actuating element on the housing of the floor processing device, for example a pushbutton, a rotary knob, a touchscreen, a slide switch or the like. For example, the actuating element can here be moved back and forth between differing operating specifications as desired, for example from a minimum amount of the respective operating parameter to a maximum amount. Depending on the type of the accessory device currently connected with the floor processing device, the user can deem another operating parameter as advantageous.

Even though the aforementioned systems already permit a user-oriented use of the floor operating device or accessory device, the user must renew their operating specifications as soon as they reactivate the floor processing device after a preceding deactivation, or change out an accessory device connected with the floor processing device.

SUMMARY OF THE INVENTION

Proceeding from the aforementioned prior art, the object of the invention is therefore to further improve the handling and adjustment of the system, in particular in such a way that the user has to perform s fewest possible work steps.

In order to achieve this object, it is proposed that the controller be set up to store the operating parameter used last for a first operating activity together with information about the type of used accessory device in the memory device and, after the accessory device has been disconnected from the floor processing device and the same accessory device has been reconnected with the floor processing device, to access the operating parameter stored in the memory device, and reset this operating parameter for a second operating activity to be performed chronologically after the first operating activity.

According to the invention, the setting of an operating parameter used last in the system is stored, so that it is again available for subsequent operating activities of the floor processing device with the same accessory device. This is based on the knowledge that the user of the system always uses a specific accessory device on the floor processing device with the same operating parameters, for example since the latter are tailored to the floor coverings they use at home or some other operating requirements. For example, operating requirements can be a specific accumulation of dirt within the household, a specific type of dirt, a specific contamination intensity or the like. When the floor processing device is reactivated or after an accessory device has been changed, the previously used operating parameter is again available for the floor processing device and/or the accessory device, and automatically used by the controller. The operating parameter can be an operating parameter that involves a component of the floor processing device, and/or an operating parameter that involves a component of the accessory device. The operating parameter selected for the operating activity can be transmitted to the system by the user in various ways. In one embodiment, the user can transmit the operating parameter to the controller via a user interface formed on the floor processing device. For example, the user interface can involve an input device like a keypad, a touchscreen or the like. In addition, the user interface can also be a data communication interface, e.g., a WLAN interface, Bluetooth interface or wired interface, which is connected with an external terminal of the user. For example, the external terminal can be a mobile terminal like a mobile phone or tablet computer, or alternatively also a local standalone computer. In the latter case, the user inputs their operating parameter via the external terminal, which then transmits the operating parameter to the controller. Once transmitted and used for an operating activity, the operating parameter is stored in the memory device of the system as history. Aside from the operating parameter, the history can here also contain other information, for example a date or time. In addition, information about the type of used accessory device is also stored with the operating parameter, so that the memory device receives complete information about which accessory device was previously used in combination with the floor processing device, and which operating parameter or operating parameters were set in the process. Within the framework of the invention, used operating parameters are understood not only as the type of operating parameter, i.e., for example a speed, a power or the like, but also an amount of the respective parameter, for example an amount relating to speed, an amount relating to power, and so on.

It is proposed that the operating parameter be selected from the following group: Power of a blower, speed of a rotating floor processing element, vibration frequency of a vibrating floor processing element, flow cross section of an air flow channel, dispensing rate of a liquid application device, position of a switching element. The operating parameter can here be allocated both to a component of the floor processing device and a component of the accessory device. What is essential is that the operating parameter is usually set by the user. In practice, for example, this can be a suction blower, which is used during a vacuum cleaning activity of the floor processing device, a speed or vibration frequency of a floor processing device that can be moved relative to a housing of the floor processing device or the accessory device. The user can also set a flow cross section of an air flow channel as the operating parameter, for example a flow cross section of a suction mouth of an accessory device and the like. In addition, the operating parameter can also be a dispensing rate of a liquid application device, which the floor processing device or accessory device uses to moisten a surface to be cleaned. The operating parameter can also be a position of a switching element, for example a position of one or several displaceable sealing lips of a nozzle, which are displaced depending on the floor type, e.g., hard floor or carpeted floor. Additional operating parameters are conceivable within the framework of the invention.

The accessory device of the system can have at least one of the following components: Suction nozzle, floor processing element, cleaning brush, upholstery cleaning device, wet cleaning device, liquid application device. The aforementioned components all serve to process a surface. Other components are also conceivable, for example grinding attachments, polishing attachments, floor polisher attachments, or the like. What is essential is that the component can be set via the setting selected by the user, namely the operating specification.

In addition, it can be provided that the memory device be a device-specific, local memory device of the floor processing device. In this case, the operating parameter used for the determined operating activity is directly stored in the floor processing device. As with the controller, the memory device is thus located in the floor processing device itself, thereby enabling a direct and rapid communication.

Alternatively, however, it can also be provided that the memory device be an external memory device relative to the floor processing device. According to this embodiment, the storage area for the data, namely the operating parameters and information about the type of used accessory device, are not located in the floor processing device itself, but rather in an external device communicatively linked with the floor processing device, for example a smartphone or the like. In addition, for example, it is possible for other floor processing devices to also access the external memory device. As a consequence, the stored data are centrally available to the user in a household with several floor processing devices.

It can be provided that a basic setting for an operating parameter of the floor processing device and/or the accessory device be stored in the memory device, wherein the controller is set up to use the basic setting for an operating activity if the user did not yet transmit any operating specification for the operating parameter to the floor processing device beforehand. As a consequence, this basic setting is used primarily for an operating activity at a time when the user first uses the system, floor processing device and/or a specific accessory for an operating activity. When starting a first operating activity of the floor processing device or the accessory device, the user can then assign a specific operating parameter, which is then stored as explained previously in the memory device, so as to be available for additional, subsequent operating parameters.

In addition, it is proposed that a transition setting for an operating parameter of the floor processing device be stored in the memory device, wherein the controller is set up to make the transition setting during an ongoing operating activity given a disconnection of the accessory device from the floor processing device. According to an embodiment, the transition setting can correspond to the basic setting. The transition setting is used so that the system can be safely used even when the user disconnects the accessory from the floor processing device during an ongoing operation. For example, the transition setting can assign a specific blower power or the like that poses no danger to the user. When changing out the accessory device during an operation, the controller of the floor processing device detects the removal of the accessory device from a corresponding interface of the floor processing device. It is likewise detected when the same or another accessory device is connected with the floor processing device again. As soon as the controller of the floor processing device detects that an accessory device is once again connected with the floor processing device, the transition setting can be replaced by a stored operating parameter for the currently connected accessory device. According to this embodiment, the user has the option of changing the accessory device during the ongoing operation of the floor processing device, for example from a suction nozzle for cleaning joints to another suction nozzle for cleaning overlay surfaces. According to the invention, he or she does not have to once again manually transmit an operating parameter to the controller after changing out the accessory device. Rather, the controller can retrieve the last used operating parameter from the memory device and then automatically set it. As an overall result, the floor processing device or accessory device switches back into a specific, stored mode when reconnected. By contrast, when initially connecting a combination comprised of the floor processing device and accessory device, the transition setting is used as a so-called default mode, so that the system can even then be operated with a defined status.

In addition, it is proposed that the memory device be a nonvolatile memory device, so that the operating parameters stored therein continue to be stored therein even after the floor processing device has been deactivated and reactivated. According to this embodiment, deactivating the floor processing device does not result in the deletion of data stored in the memory device, namely the operating parameters and the allocated information about the type of used accessory device. If the user hooks up an accessory to the floor processing device that he or she had already used earlier—possibly even after having changed out the accessory device on the floor processing device once or several times—at a later point in time, for example after several days or even weeks, the operating parameters previously used in conjunction with this accessory device remain available. The user does not have to again make a selection relating to the preferred operating parameters. The data stored in the memory device are thus also retained even beyond a shutdown phase of the floor processing device, and are again available given a resumption of an operating activity with the previous accessory device. Notwithstanding the above, however, the user can even make any desired change to the operating parameter at a later point.

Alternatively, it can also be provided that the content of the memory device be deleted after deactivating the floor processing device, so that the operating parameters and information about the type of accompanying accessory device stored therein are no longer available. As soon as the user then uses an accessory device again, whose data were previously deleted from the memory device, the floor processing device or the accessory device is preferably operated in a so-called default mode, which represents a basic setting for an operating parameter of the floor processing device and/or the accessory device. This basic setting is used if the user has not yet individually (re)set operating parameters for the respective accessory device. However, if individual operating parameters are then set again, they will be available in the memory device once more until such time as the user deactivates the floor processing device again.

It can be provided that the user interface be set up to receive a delete command for deleting an operating parameter stored in the memory device. According to this embodiment, the user can also suppress the inventive behavior of the floor processing device by manually deleting an operating parameter stored in the memory device. For example, the ability to delete previously used operating parameters can be advantageous when using a floor processing device or accessory device that is capable of both wet cleaning and dry cleaning. For example, if wet cleaning initially takes place within the framework of a floor processing activity and is then followed by a dry cleaning, it can make sense after concluding the wet cleaning process and interrupting the operation of the floor processing device to not carry out a wet cleaning operation again with corresponding operating parameters, but rather a dry cleaning operation. In this case, returning to a wet cleaning mode would thus be undesirable. If the user manually deletes the last used operating parameters, a renewed use of the floor processing device or accessory device would have it operating in particular with a basic setting, which defines a default mode for the floor processing device in conjunction with a specific accessory device.

Finally, it can be provided that the accessory device have a clear identification code, wherein the acquisition device of the floor processing device is set up to receive the identification code, and wherein the controller is set up to identify the accessory device based on the received identification code and retrieve an operating parameter allocated to the identified accessory device from the memory device. The system advantageously comprises a floor processing device and at least one accessory device, which have corresponding communications interfaces. For example, the communications interfaces involve device interfaces such as a WLAN interface or Bluetooth interface. In another configuration, the communications interfaces can also be wired, i.e., in the form of a device-specific bus system, which provides corresponding connection interfaces. Such communications interfaces are used in the sense of the invention to identify other participants in the communications network before data are subsequently exchanged. An identification phase takes place at the beginning of a communications sequence so that the controller of the floor processing device can identify a connected accessory device. The controller of the floor processing device here preferably reads identification data out of the accessory device. In addition, the controller of the floor processing device can preferably also identify purely passive accessory devices, which themselves do not have a communications interface, for example a suction nozzle without active functions. In this case, for example, an optical code can be applied to the housing surface of the accessory device, which the acquisition device of the floor processing device can read. The identification phase especially preferably serves to identify electrical accessory devices that have a communications interface. In this embodiment, the communications interface thus initially serves to identify an accessory device connected with the floor processing device, and subsequently to transmit operating parameters from the memory device of the floor processing device to the accessory device. This makes it possible to access the operating parameters stored in the memory device after the accessory device is disconnected from the floor processing device and the same accessory device is once again connected with the floor processing device, and to reset this operating parameter for a subsequent operating activity. Based on the identification code, the controller of the floor processing device receives information about the identity or at least the type of connected accessory device, so that the accompanying operating parameters can be read out of the memory device and set. The identification code can be an optical code, for example like a barcode, QR code or the like. In addition, the identification code can also be a purely electronic identification, which clearly identifies the accessory device.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
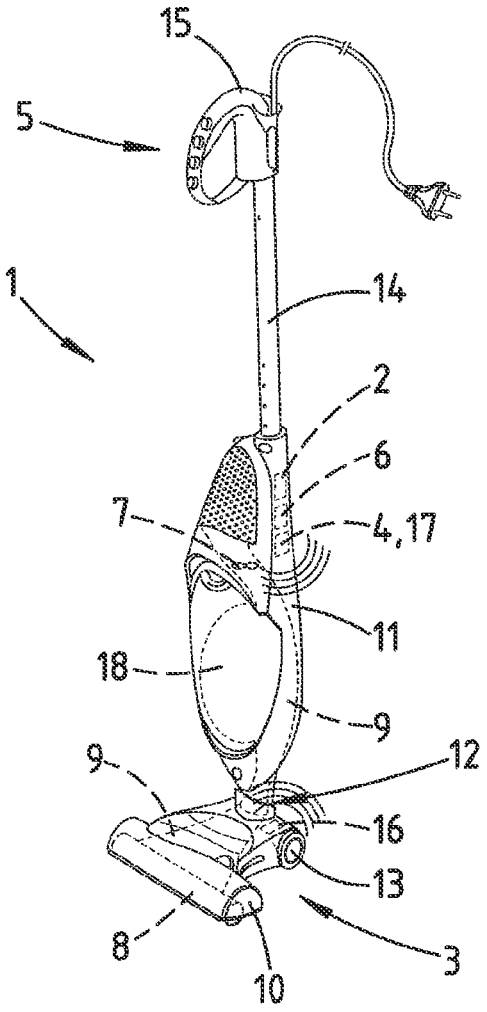
FIG. 1 is a system according to the invention with a floor processing device and an accessory device.

FIG. 1 shows a possible exemplary embodiment of a system according to the invention comprised of a floor processing device 1, a memory device 2 arranged in the floor processing device 1 and an accessory device 3. The floor processing device 1 has a base unit 11 with a connection interface 12, to which the accessory device 3 can be connected. The connection interface 12 is used to detachably connect the accessory device 3. Aside from the accessory device 3 shown just as an example here, the floor processing device 1 can alternatively be connected with other identical or different accessory devices 3.

The floor processing device 1 is here exemplarily designed as a standard household vacuum cleaner. The floor processing device 1 has a conventional dust chamber 18 and blower 7, which are connected with each other in terms of flow by an air flow channel 9. In addition, the air flow channel 9 empties into the connection interface 12, where it can be connected with a corresponding air flow channel 9 of the accessory device 3. Furthermore, a handle 14 with a grip 15 is located on the base unit 11 of the floor processing device 1. The handle 14 is preferably telescoping, so that a user of the floor processing device 1 can advantageously adjust the length of the handle 14 to their body size. The grip 15 allows the user to guide the floor processing device 1 over a surface to be cleaned, wherein he or she usually moves the floor processing device 1 back and forth over the surface. The grip 15 has a user interface 5, which allows the user to transmit inputs to a controller 6 of the floor processing device. For example, the input can be an operating specification for an operating parameter of the floor processing device 1 and/or the accessory device 3. For example, an operating parameter is a power level of the blower 7. In addition, the floor processing device 1 has a communications interface 17 for communicating with a corresponding communications interface 16 of the accessory device 3. The communications interface 17 simultaneously serves as an acquisition device 4, with which the floor processing device 1 can acquire a type of accessory device 3 currently connected with the floor processing device 1. The corresponding communications interfaces 16, 17 of the floor processing device 1 and the accessory device 3 are here designed as wireless communications interfaces 16, 17 solely by way of example, e.g., as WLAN modules, Bluetooth modules, ZigBee modules or the like. Alternatively, however, the communications interface 16, 17 can also be wired, e.g., as part of a device-specific bus system.

In the exemplary embodiment shown here, the accessory device 3 has a suction nozzle 10 and a floor processing element 8 for processing a surface to be cleaned. For example, the floor processing element 8 is here a cleaning roller that rotates around an essentially horizontal axis of rotation, and can preferably be fitted with cleaning brushes, for example. The accessory device 3 has wheels 13, so that the floor processing device 1 or the accessory device 3 can be moved over the surface to be cleaned with as little friction as possible.

The user interface 5 of the floor processing device 1 has a selector, here for example with four key elements. Each of the key elements corresponds to one of four possible blower stages of the blower 7 of the floor processing device 1. A first blower stage "Suction stage 1" here has the lowest blower power, while a fourth blower stage "Suction stage 4" provides the highest possible blower power. By actuating a key element, the user can thus transmit an operating specification for a specific suction stage to the controller 6 of the floor processing device 1, which then controls the setting of the desired blower stage accordingly.

In addition, however, the controller 6 of the floor processing device 1 is also designed in such a way that requires the user to make the fewest inputs possible at the user interfaces 5. For this purpose, the controller 6 is designed to store earlier operating parameters of the user, and intelligently evaluate them so that a suction stage assumed as desired by the user is automatically set under specific conditions. This will be explained in more detail below.

FIG. 2 exemplarily shows an automatic control of the blower power as a controllable operating parameter of the floor processing device 1. Alternatively, other operating parameters of the floor processing device 1 or the accessory device 3 can also be controlled. For example, it would alternatively or additionally be possible to also control a speed of the rotating floor processing element 8 of the accessory device 3, an adjustable air guide that influences a flow cross section of the air flow channel 9 of the accessory device 3 and/or the floor processing device 1, and the like.

Figure 2A:
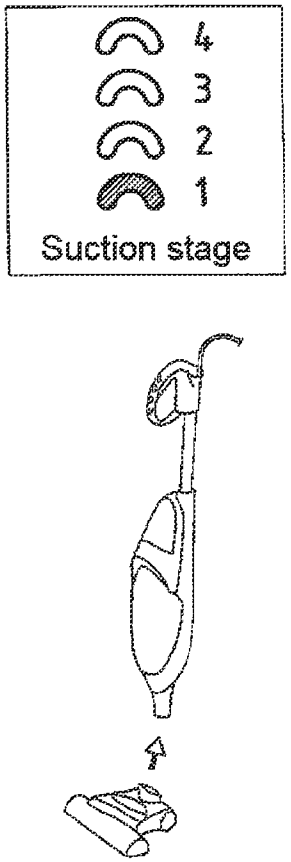
FIGS. 2A to 2E show an exemplary operation of the system with varying connection situations of the floor processing device and accessory device.
Figure 2B:
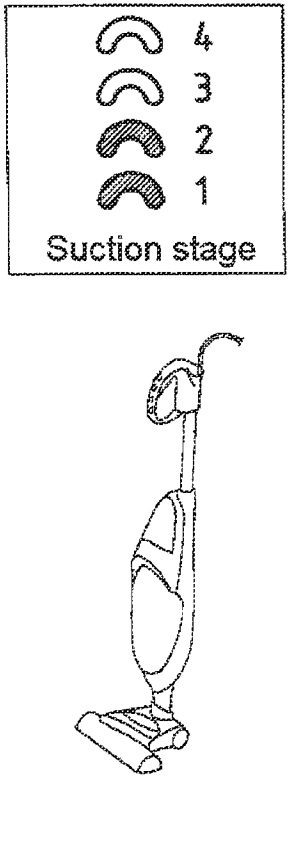

Shown from left to right on FIGS. 2A to 2E are various connection states of the system comprised of the floor processing device 1 and accessory device 3, wherein the states are characterized by either a connected state of the floor processing device 1 and accessory device 3, or by a disconnected state. In a chronological sequence from left to right, the invention now functions in such a way that the floor processing device 1 is initially operated separately, i.e., without a connected accessory device 3 (FIG. 2A). The blower 7 of the floor processing device 1 is here operated in a "solo mode", which provides a minimal suction power of the blower 7 that is here designated as "Suction stage 1". This operating mode corresponds to a transitional setting for the operating parameter "Blower power", wherein the controller 6 of the floor processing device 1 controls the blower 7 in such a way that the suction power is the lowest possible. In this suction stage, the user can use the floor processing device 1 without the connected accessory device 3, for example to perform an overhead cleaning of a ceiling, vacuum up coarse material or the like. In a second step labeled as "Basic" on FIG. 2B, the user has hooked up the accessory device 3 to the connection interface 12 of the floor processing device 1. When the accessory device 3 is hooked up to the connection interface 12, the acquisition device 4 of the floor processing device 1 detects the type of accessory device 3 currently connected with the floor processing device 1, here also in particular an individual identification code of the accessory device 3. For this purpose, the corresponding communications interfaces 16, 17 of the floor processing device 1 and the accessory device 3 exchange information. Using a contact switch at the connection interface 12 of the floor processing device 1, for example, the controller 6 of the floor processing device 1 can detect that the accessory device 3 has been hooked up to the connection interface 12, and start a communication with the accessory device 3. Alternatively, it is also possible for data communication to start from the accessory device 3 which detects the connection with the connection interface 12 of the floor processing device 1. An identification phase subsequently takes place via the mutual interfaces 16, 17, which identifies the accessory device 3 in relation to the controller 6 of the floor processing device. For example, this can take place in such a way that, upon detecting that an accessory device 3 has been hooked up to the connection interface 12, the controller 6 initially transmits an identification query to the accessory device 3. In response to the identification query, the accessory device 3 or a controller allocated thereto transmits its identification code to the floor processing device 1 using the communications interfaces 16, 17. For example, the identification code is here a purely electronic identification code, which can consist of numbers and/or letters, and can unambiguously distinguish the accessory device 3 from other accessory devices 3 of the system. In the situation depicted here, which is described with "Basic", the floor processing device 1 as yet has no knowledge about the accessory device 3, and in particular about its operating parameters to be set. For this reason, the controller 6 of the floor processing device 1 controls the blower 7 in such a way as to make a basic setting, which is defined for the case where a user has previously not yet transmitted any operating specification for the operating parameter "Blower power" to the floor processing device 1. For example, the basic setting is here the blower power setting "Suction stage 2". This basic setting is also referred to colloquially as "Default". The controller 6 of the floor processing device 1 accesses such a setting if a user has not yet made any individual operating specification.

Figure 2C:
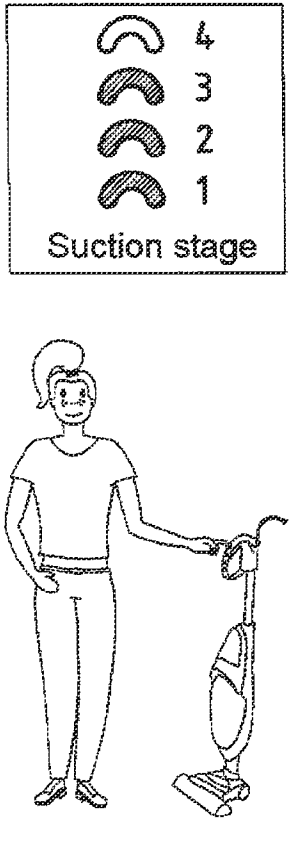

In the situation labeled as "Manual" on FIG. 2C, the user subsequently makes a manual user input, which defines the setting of the suction stage 3 as the operating specification for the operating parameter "Blower power". For this purpose, the use presses a key element at the user interface 5. The controller 6 detects the operating specification, and controls the blower 7 in such a way that the desired blower power "Suction stage 3" is set. At the same time, the controller 6 stores the operating specification selected by the user together with the information about the type of used accessory device 3 in the memory device 2 of the floor processing device 1. The memory device 2 of the system is here a device-specific local memory device 2 of the floor processing device 1. Alternatively, however, the memory device 2 can also be arranged in any other device of the system, for example in a mobile external computer device of the user. The memory device 2 is preferably designed as a nonvolatile memory device 2, so that the operating parameters and information about the type of used accessory device 3 stored therein, in particular the identification code of the accessory device 3, are permanently available, even when the user turns off the floor processing device 1 and later operates it again. According to an alternative embodiment, it is possible for the contents of the memory device 2 to be deleted when the user turns off the floor processing device 1.

Figure 2D:
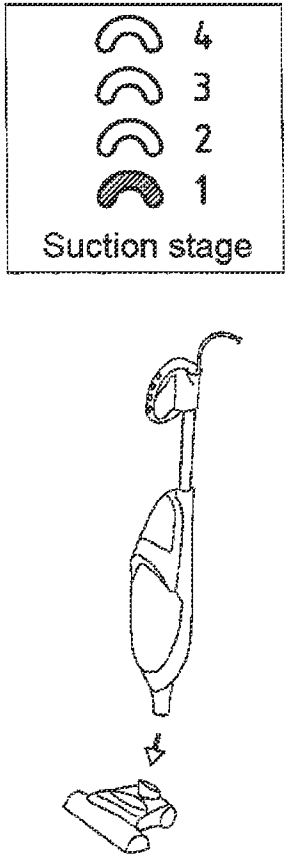
Figure 2E:
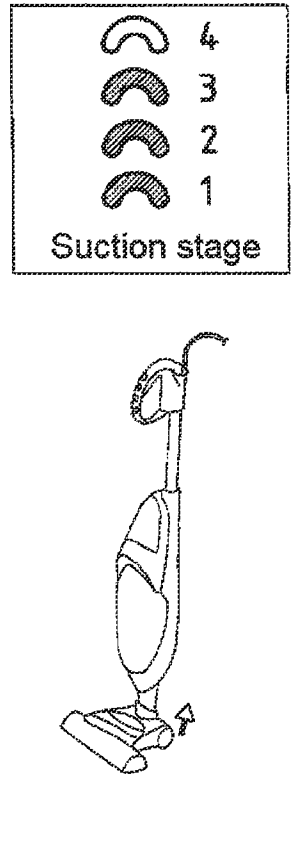

FIG. 2D shows a later point in time at which the user has again disconnected the accessory device 3 from the floor processing device 1. The controller 6 detects that the accessory device 3 was disconnected from the connection interface 12, and controls a transitional setting for the operating parameter "Blower power" of the floor processing device 1, which here corresponds to the default setting "Suction stage 1". The user can disconnect the accessory device 3 from the floor processing device 1 during the ongoing operation of the blower 7. The reduction in blower power then preferably takes place at the moment when the accessory device 3 is decoupled from the connection interface 12.

If the user reconnects the same accessory device 3 with the floor processing device 1 at a later point in time, the controller 6 of the floor processing device 1 reads the setting stored for the individual identification code of the accessory device 3 out of the memory device 2. This is shown on FIG. 2E. While connecting the accessory device 3 with the floor processing device 1, the identification phase described above first takes place, which gives the controller 6 knowledge about the individual identification code of the accessory device 3. The controller 6 then queries the memory device 2 for the operating parameter stored for this identification code. The user had here last set "Suction stage 3" by manually actuating the operating specification, so that it was stored in the memory device 2. The controller 6 now also controls the blower 7 accordingly, and sets "Suction stage 3".

In specific cases, it can be advantageous that the operating parameter last used on the floor processing device 1 or accessory device 3 not be automatically set when the floor processing device 1 is reconnected with the accessory device 3. For example, this makes sense if the accessory device 3 can perform various tasks, for example a wet cleaning and a dry cleaning. For example, in order not to return to a wet cleaning in this case, but rather to be able to perform the ensuing dry cleaning step, the user can manually delete or at least suspend the application of the previously stored operating parameter via the user interface 5. According to an embodiment, the user can also completely delete the operating parameter stored in the memory device 2. The floor processing device with the accessory device 3 is then again operated in the "Basic setting" mode, i.e., the blower 7 is operated with "Suction stage 2", which corresponds to the default setting.

Although only a few embodiments of the present invention have been shown and described, it is to be understood that many changes and modifications may be made thereunto without departing from the spirit and scope of the invention.

REFERENCE LIST

1 Floor processing device
2 Memory device
3 Accessory device
4 Acquisition device
5 User interface
6 Controller
7 Blower
8 Floor processing element
9 Air flow channel
10 Suction nozzle
11 Base unit
12 Connection interface
13 Wheel
14 Handle
15 Grip
16 Communications interface
17 Communications interface
18 Dust chamber

What is claimed is:

1. A system comprising:

a floor processing device, a memory device, and at least one accessory device for detachable connection with the floor processing device, wherein the floor processing device has an acquisition device configured for acquiring a type of accessory device currently connected with the floor processing device, a user interface configured for receiving an operating specification for an operating parameter of the floor processing device or the accessory device from a user, and a controller configured for controlling an operating activity of the floor processing device or the accessory device according to the set operating parameter, wherein the controller is set up to store the operating parameter used last for performing a first operating activity together with information about a type of accessory device used while performing the first operating activity in the memory device and, after the accessory device has been disconnected from the floor processing device and the same accessory device has been reconnected with the floor processing device, to access the operating parameter stored in the memory device, and reset this operating parameter for a second operating activity of the floor processing device with this accessory device to be performed chronologically after the first operating activity, so that the operating parameter used previously during the first operating activity is again available for the floor processing device or the accessory device, and automatically used to also perform the second operating activity.

2. The system according to claim 1, wherein the operating parameter is selected from the group consisting of: power of a blower, speed of a rotating floor processing element, vibration frequency of a vibrating floor processing element, flow cross section of an air flow channel, dispensing rate of a liquid application device, and position of a switching element.

3. The system according to claim 1, wherein the al least one accessory device has at least one of the following components: suction nozzle, floor processing element, cleaning brush, upholstery cleaning device, wet cleaning device, liquid application device.

4. The system according to claim 1, wherein the memory device is a device-specific local memory device of the floor processing device.

5. The system according to claim 1, wherein the memory device is an external memory device relative to the floor processing device.

6. The system according to claim 1, wherein a basic setting for the operating parameter of the floor processing device or the accessory device is stored in the memory device, wherein the controller is set up to use the basic setting for an operating activity if the user did not yet transmit any operating specification for the operating parameter to the floor processing device beforehand.

7. The system according to claim 1, wherein a transition setting for the operating parameter of the floor processing device is stored in the memory device, wherein the controller is set up to make the transition setting during an ongoing operating activity given a separation of the at least one accessory device from the floor processing device.

8. The system according to claim 1, wherein the memory device is a nonvolatile memory device, so that the operating parameter stored therein continues to be stored therein even after the floor processing device has been deactivated and reactivated.

9. The system according to claim 1, wherein the user interface is set up to receive a delete command for deleting the operating parameter stored in the memory device.

10. The system according to claim 1, wherein the at least one accessory device has a clear identification code, wherein the acquisition device of the floor processing device is set up to receive the identification code, and wherein the controller is set up to identify the at least one accessory device based on the received identification code and retrieve an operating parameter allocated to the identified at least one accessory device from the memory device.

* * * * *